United States Patent [19]

Trudeau

[11] Patent Number: 5,066,020

[45] Date of Patent: Nov. 19, 1991

[54] DART CARD GAME BOARD

[76] Inventor: Albert D. Trudeau, 31514 Hipshot Dr., Castaic, Calif. 91384

[21] Appl. No.: 597,552

[22] Filed: Oct. 15, 1990

[51] Int. Cl.[5] ..... F41J 3/00; A63B 65/02

[52] U.S. Cl. ..... 273/408; 273/416

[58] Field of Search ..... 273/408, 409, 416

[56] References Cited

U.S. PATENT DOCUMENTS

| | | | |
|---|---|---|---|
| D. 279,302 | 6/1985 | Wood | 273/409 X |
| 1,663,385 | 3/1928 | Reinheimer | 273/408 |
| 2,179,471 | 11/1939 | Lee | 273/407 X |
| 2,214,486 | 9/1946 | Snyder | 273/409 |
| 3,891,214 | 6/1975 | Scullin | 273/408 |
| 4,314,703 | 2/1982 | Grottola | 273/408 |

*Primary Examiner*—William H. Grieb

*Attorney, Agent, or Firm*—Leon Gilden

[57] ABSTRACT

A board arrangement, including an inner and outer annular array of targets wherein the targets define triangular sections to accommodate simulation of a conventional fifty-two card game deck and associated wild cards, with a "joker" bull's-eye central target member. Four sets of five dart members are provided, wherein a player is permitted to "draw" five darts of the sets to accommodate play of various card game arrangements to permit enhancement and detraction of points awarded by utilizing particular "suits" of darts in an effort to impact upon a similar target on the board of a like suit.

1 Claim, 7 Drawing Sheets

DART CARD GAME BOARD

BACKGROUND OF THE INVENTION

1. Field of the Invention

The field of invention relates to dart board structures, and more particularly pertains to a new and improved dart card game board wherein the same associates playing cards and target darts in effecting play of card games utilizing an element of chance and skill employing darts of preselected card suits to include clubs, diamonds, hearts, and spades.

2. Description of the Prior Art

Various dart board game structures have been set forth in the prior art, but have heretofore not availed themselves of a dart board arrangement to permit employment of playing card simulation in a manner as set forth by the instant invention in employing a dart board. Examples of the prior art include U.S. Pat. No. 4,314,703 to Grottola wherein a dart game and board rotatably mounted and provided with fifty-two cards of a standard bridge deck, with each target space including a slot to insert a card to hide the indicia from opposing players.

U.S. Pat. No. 3,891,214 to Scullin sets forth a dart board and cage, with the cage demarcated into various target areas.

U.S. Pat. No. 2,214,486 to Snyder sets forth a dart board divided into various demarcations of a rectangular array.

U.S. Pat. No. 2,179,471 to Lee sets forth a dart board utilizing simulated card members mounted upon a dart board in a plurality of annular arrays utilizing singular darts of generic construction to effect impact upon target spaces.

As such, it may be appreciated that there continues to be a need for a new and improved dart card game board as set forth by the instant invention which addresses both the problems of ease of use and enhancement of play utilizing skill in combination with elements of chance to effect play of simulated card games.

SUMMARY OF THE INVENTION

In view of the foregoing disadvantages inherent in the known types of dart board construction now present in the prior art, the present invention provides a dart card game board wherein the same utilizes associated darts of discrete card suits in association with a game board of a matrix of targets simulating a bridge type card deck to effect play and employment of various card type games. As such, the general purpose of the present invention, which will be described subsequently in greater detail, is to provide a new and improved dart card game board which has all the advantages of the prior art dart game boards and none of the disadvantages.

To attain this, the present invention provides a board arrangement, including an inner and outer annular array of targets wherein the targets define triangular sections to accommodate simulation of a conventional fifty-two card game deck and associated wild cards, with a "joker" bull's-eye central target member. Four sets of five dart members are provided, wherein a player is permitted to "draw" five darts of the sets to accommodate play of various card game arrangements to permit enhancement and detraction of points awarded by utilizing particular "suits" of darts in an effort to impact upon a similar target on the board of a like suit.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved dart card game board which has all the advantages of the prior art dart game boards and none of the disadvantages.

It is another object of the present invention to provide a new and improved dart card game board which may be easily and efficiently manufactured and marketed.

It is a further object of the present invention to provide a new and improved dart card game board which is of a durable and reliable construction.

An even further object of the present invention is to provide a new and improved dart card game board which is susceptible of a low cost of manufacture with regard to both materials and labor, and which accordingly is then susceptible of low prices of sale to the consuming public, thereby making such dart card game boards economically available to the buying public.

Still yet another object of the present invention is to provide a new and improved dart card game board which provides in the apparatuses and methods of the prior art some of the advantages thereof, while simultaneously overcoming some of the disadvantages normally associated therewith.

Still another object of the present invention is to provide a new and improved dart card game board wherein the same employs distinct darts of various simulated card suits in play of simulated card games.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
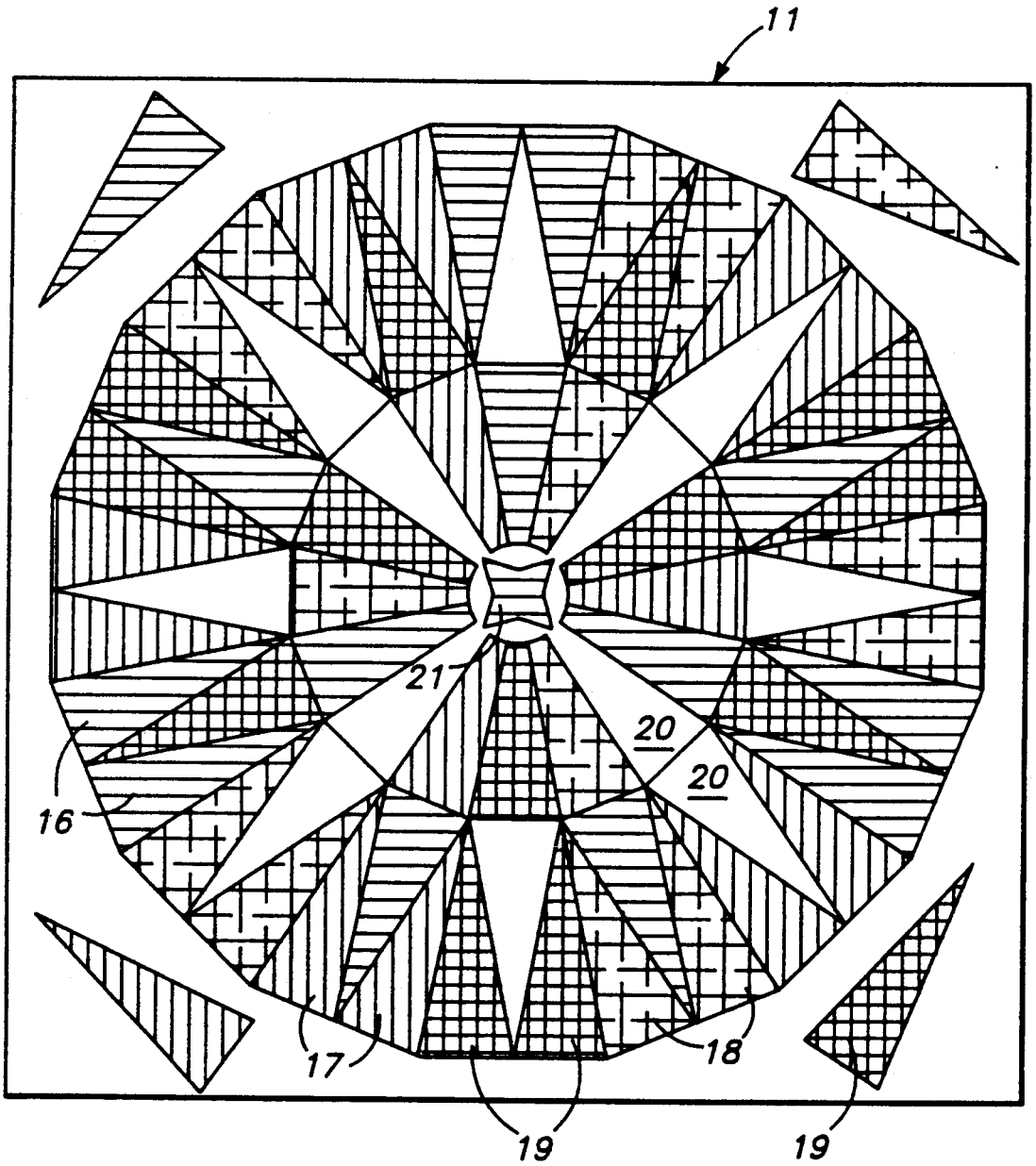
FIG. 1 is an orthographic top view of the board utilized by the instant invention and the various color pattern arrangements.

With reference now to the drawings, and in particular to FIGS. 1 to 8 thereof, a new and improved dart card game board embodying the principles and concepts of the present invention and generally designated by the reference numeral 10 will be described.

Figure 7:
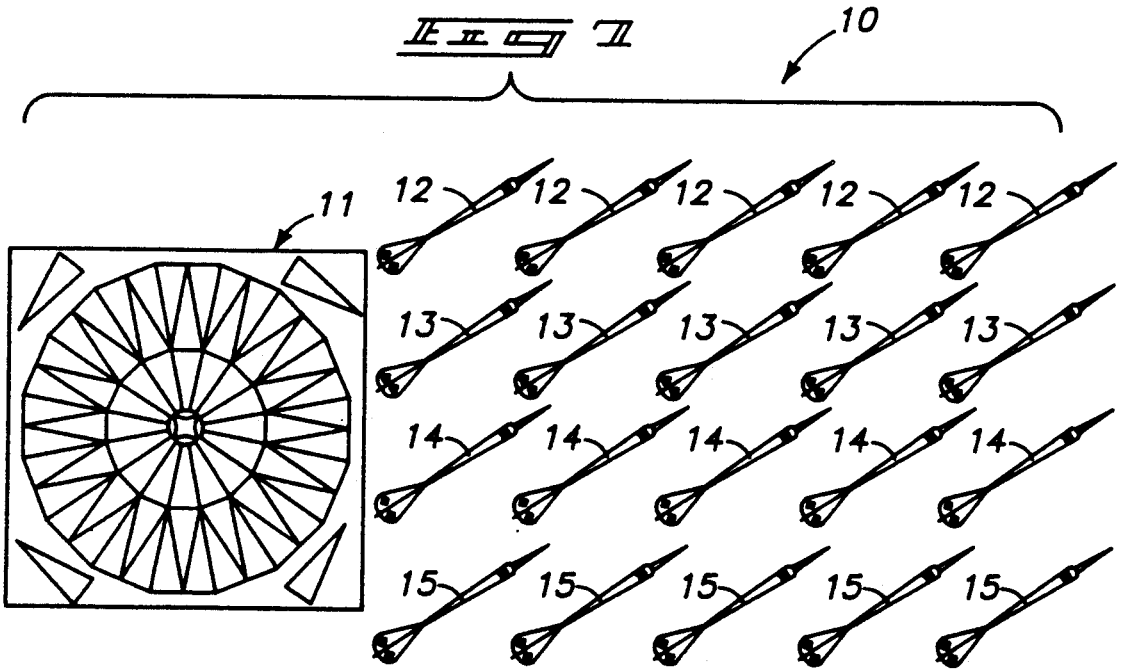
FIG. 7 is an orthographic indication of the components utilized by the instant invention.
Figure 3:
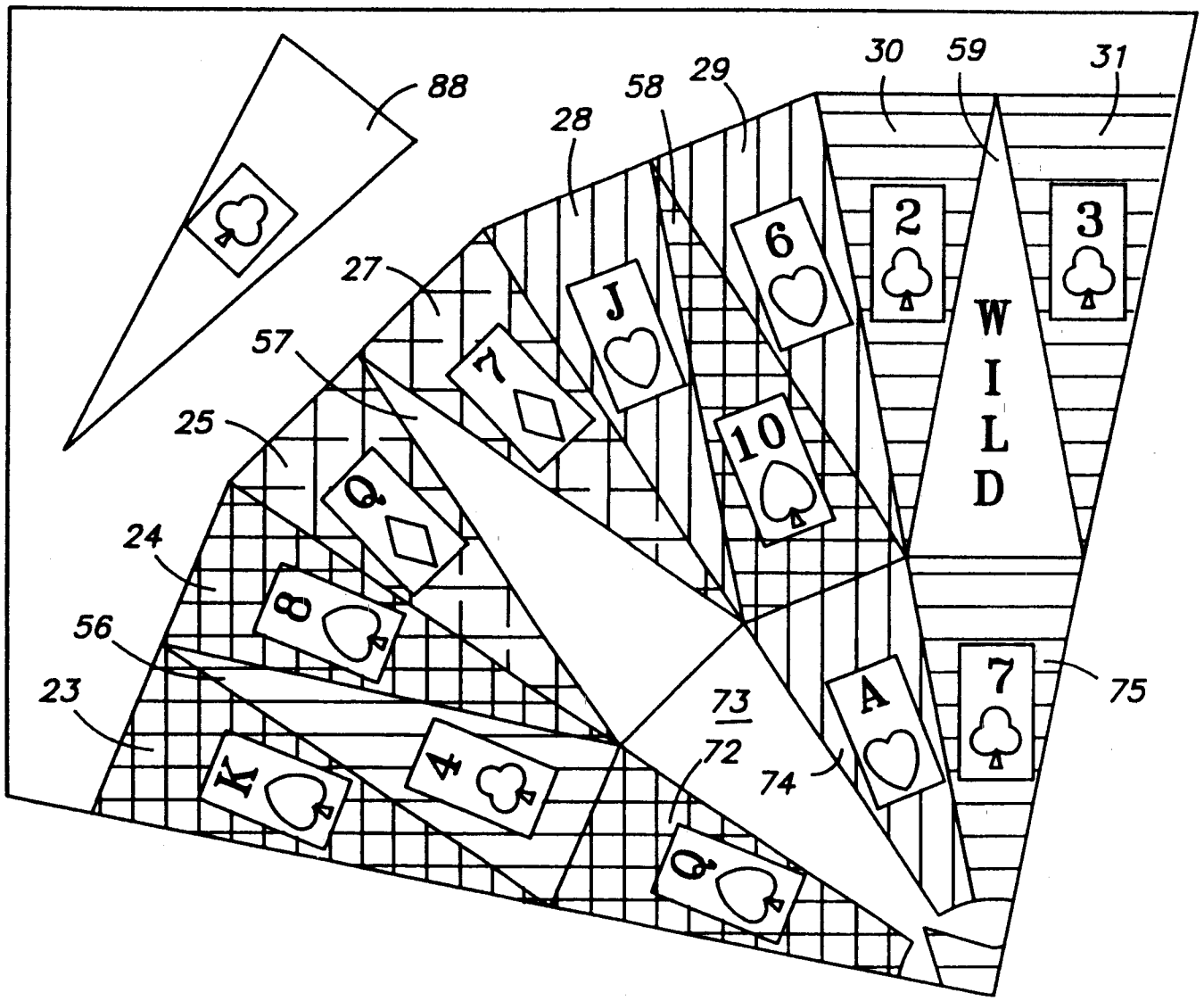
FIG. 3 is an orthographic top view of FIG. 3 as set forth in FIG. 2.
Figure 4:
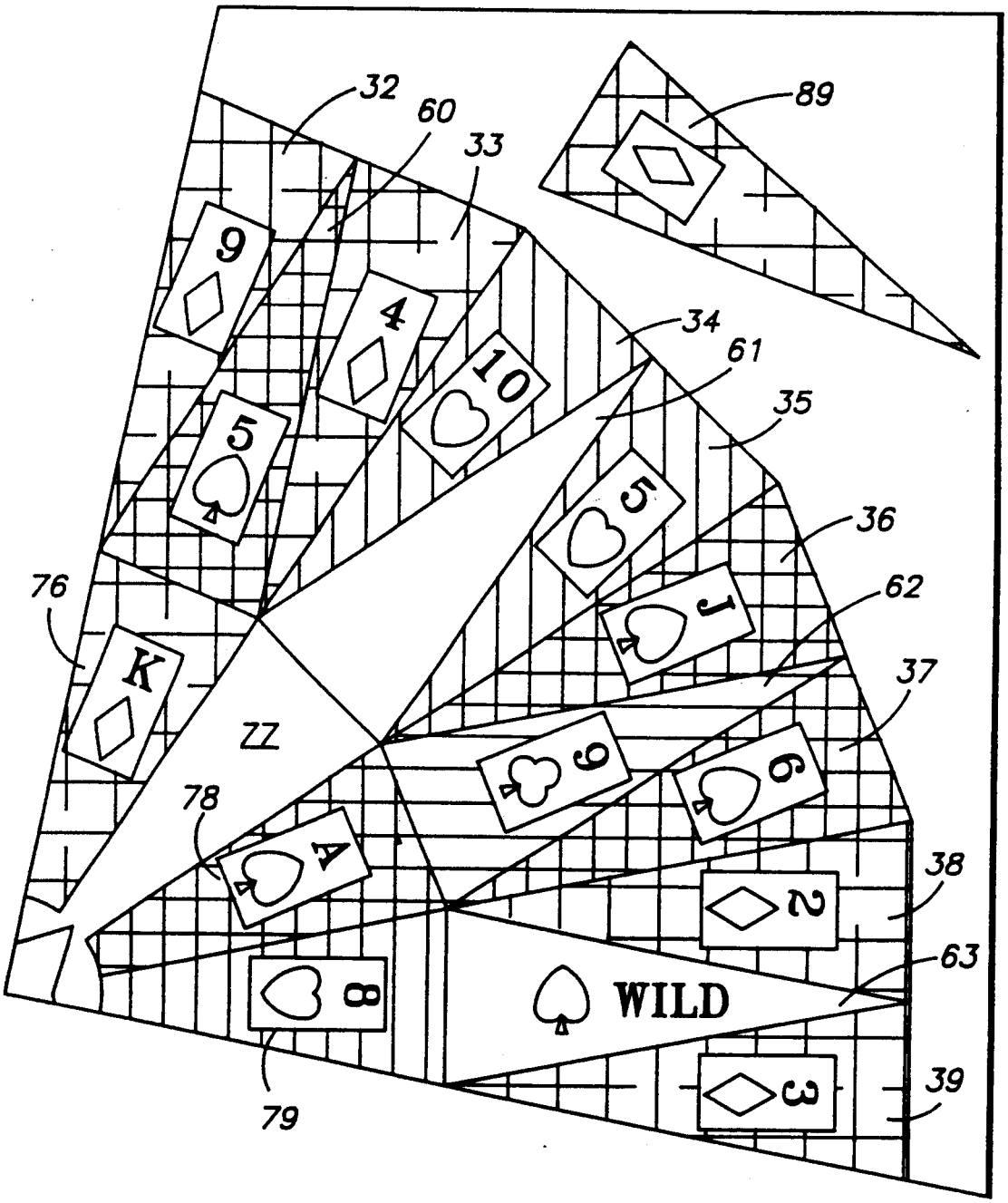
FIG. 4 is an orthographic top view of FIG. 4 as set forth in FIG. 2.
Figure 5:
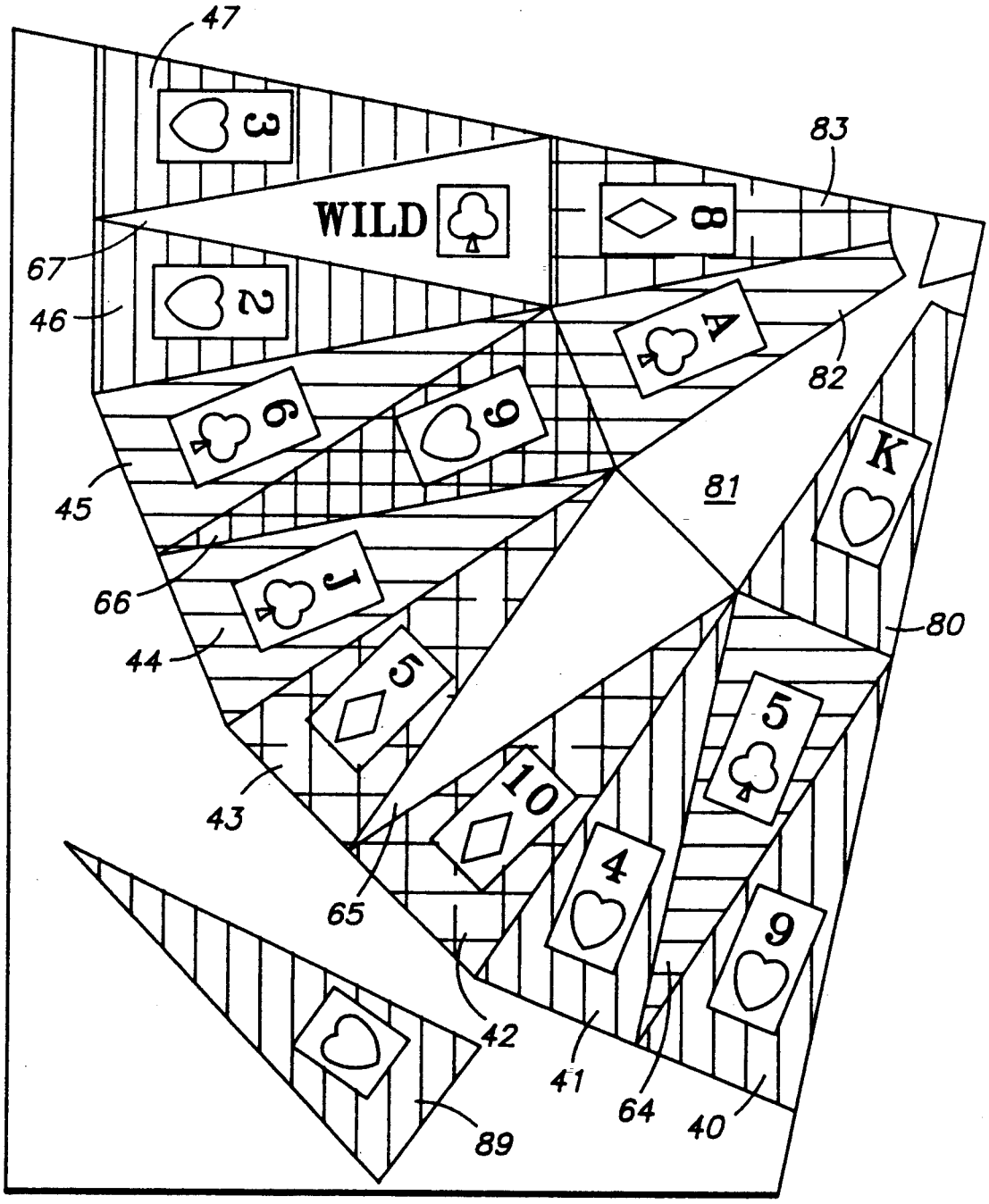
FIG. 5 is an orthographic top view of FIG. 5 as set forth in FIG. 2.
Figure 6:
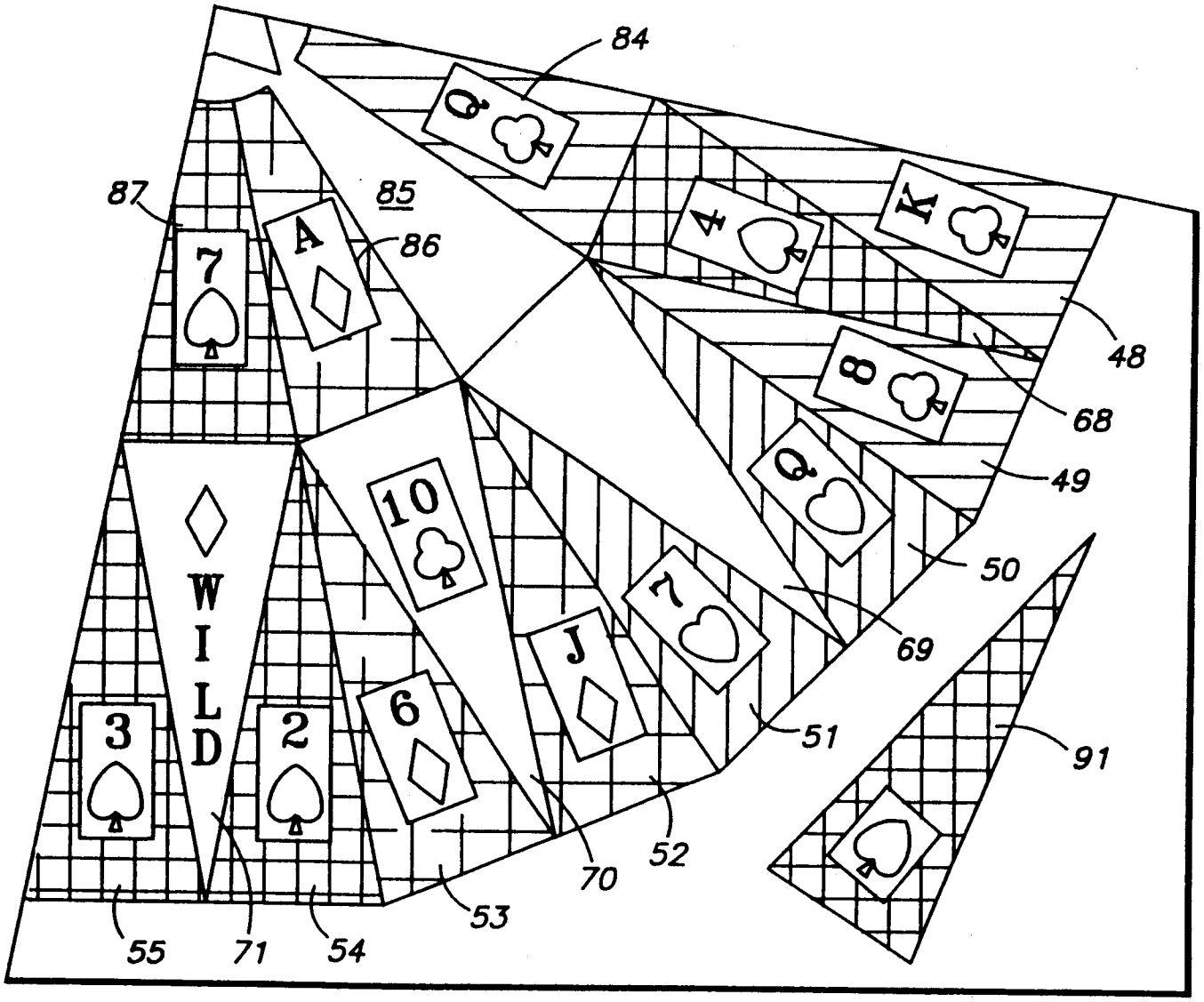
FIG. 6 is an orthographic top view of FIG. 6 as set forth in FIG. 2.

More specifically, the dart card game board 10 of the instant invention essentially comprises a playing board 11 defined by an outer circular target array and an inner circular target array, with an axially positioned bull's-eye target. The playing board is defined by four distinct colorations to define the club, heart, diamond, and spade designations of a bridge-type deck of playing cards, including a first category of colorations 16, a second category of colorations 17, a third category of colorations 18, and a fourth category of colorations 19 to define the respective clubs, hearts, diamonds, and spade suits of a playing card, with each category of coloration defining a triangular target zone. Reference to FIG. 7 illustrates the use of four sets of darts defining a first set 12, a second set 13, a third set 14, and a fourth set 15, with each set defining five darts and each set defined by the respective clubs, hearts, diamonds, and spades designation respectively. It should also be noted that in the category of colorations, a fifth category of colorations 20 is defined by blank zones to define a non-awarding of points or may selectively be utilized to define a deduction of points in the playing of a game, with a sixth bull's-eye target 21 positioned coaxially of the playing board 11.

Figure 2:
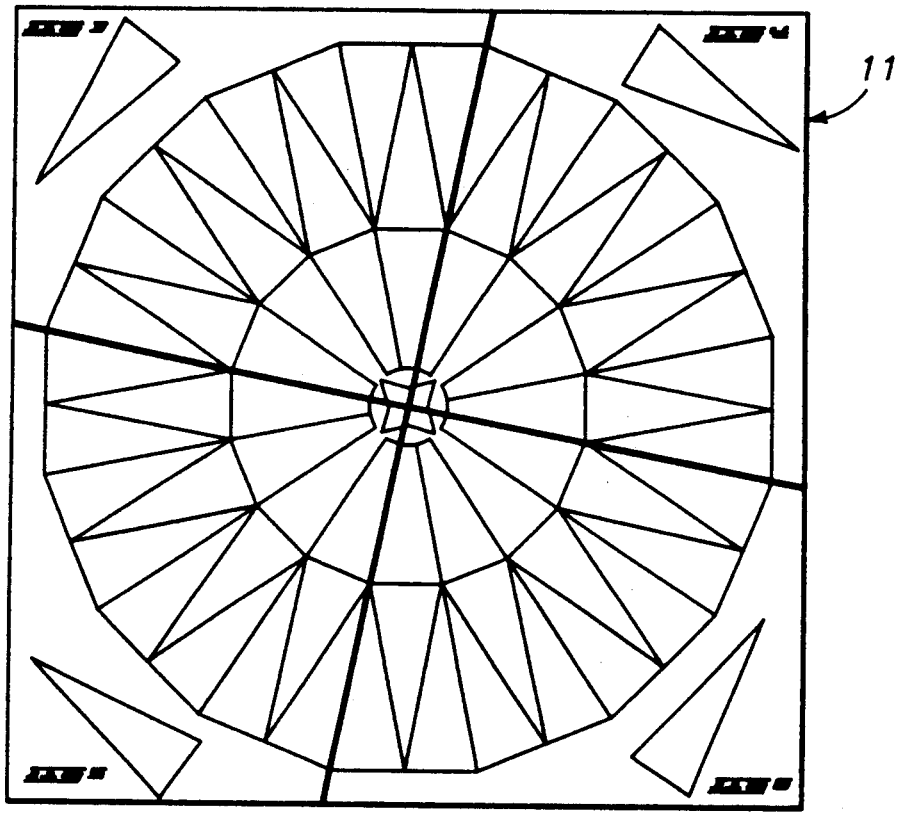
FIG. 2 is an orthographic top view of the game board divided into four quadrant sections.

FIGS. 3–6, as defined by FIG. 2, sets forth the outer circular target array defining the triangular target zones 23–71 defining the simulated playing cards in a conventional bridge-type deck, wherein an inner circular array positioned coaxially and interiorly of the outer circular array is defined by the triangular target zone 72–87. It should be noted that the triangular target zones 57, 61, 65, 69, 73, 77, 81, and 85 define blank target zones throughout the playing board spaced at equal spacings throughout defined by a respective first, second, third, fourth, fifth, sixth, seventh, and eighth blank target zone. "Wild" target zones are defined by the first, second, third, and fourth triangular target zones 59, 63, 67, and 71. These "wild" triangular target zones may be utilized once in each respective turn by a player to designate any desired simulated card within the simulated card deck that individual requires. Similarly, the sixth bull's-eye target joker target 22 may also be utilized only once in a respective turn by an individual.

Each player is randomly provided five of the darts of the four sets of darts, and the player may further be awarded additional points by impacting a triangular target zone by a designated dart of the respective clubs, hearts, diamonds, and spades categories. For example, an individual with a first category of dart 16 defining a "clubs" suit may impact the triangular target zone 31 to define the three of clubs for awarding of a bonus point total utilizing conventional hierarchy of poker hands, such as three of a kind, a full house, four of a kind, etc. to define a conventional hierarchy of point totals afforded a player. Further, the first, second, third, and fourth space targets 88, 89, 90, and 91 positioned exteriorly of the outer circular target array at diametrically opposed portions of the playing board and may be impacted by a respective category of darts of the first, second, third, and fourth category of darts defined by the darts 12, 13, 14, and 15 to permit an individual to effect a payment of various heart, club, etc. flushes, i.e. a procession of a singular suit.

Figure 8:
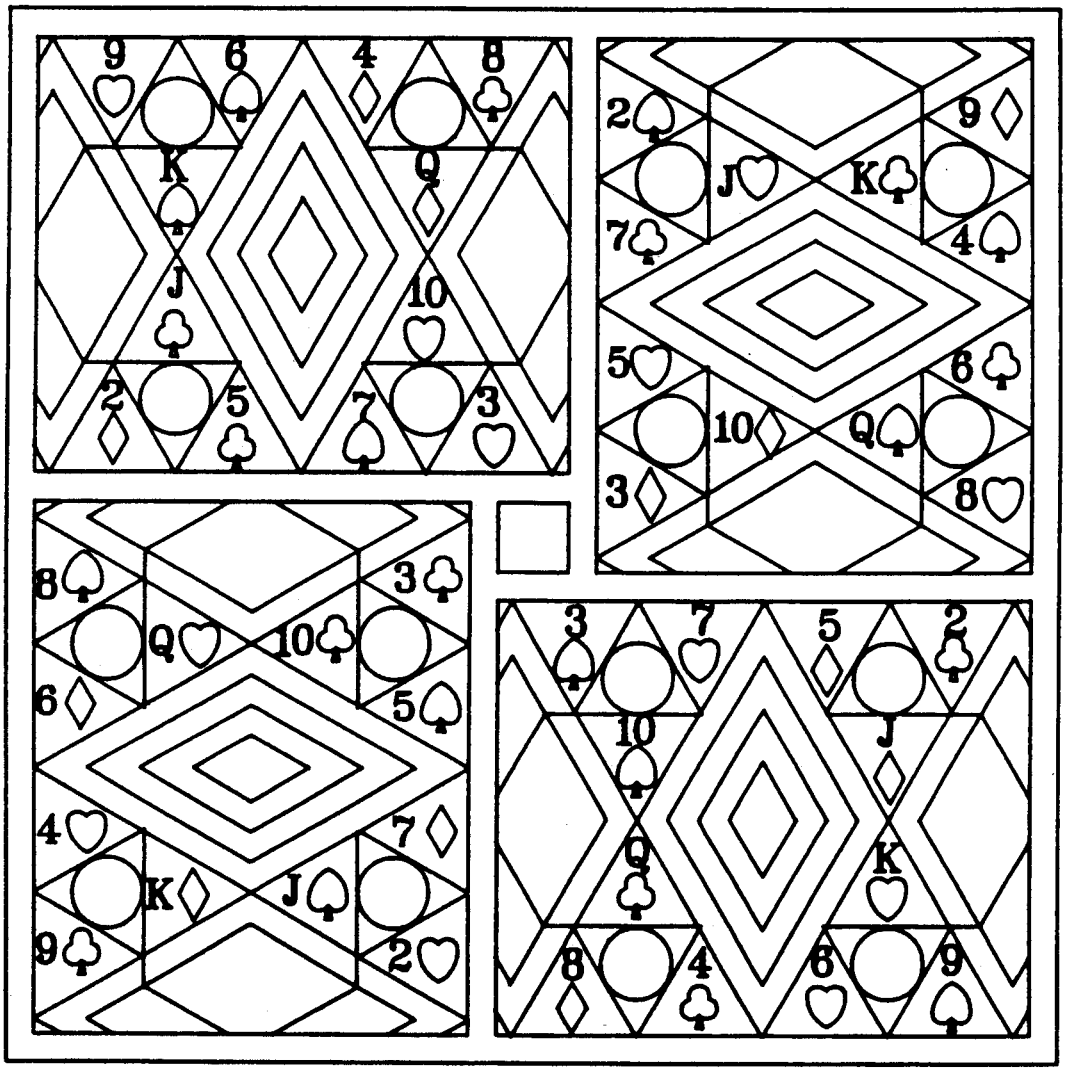
FIG. 8 is an orthographic top view of a further pattern structure in a dart board utilized by the instant invention.

FIG. 8 illustrates a further example of a target array, as may be utilized by the instant invention.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of playing a dart card game comprising the steps of, providing a playing board, with the playing board demarcated by a first, second, third, and fourth coloration which defines a club suit, the second coloration defines a heart suit, the third coloration defines a diamond suit, and the fourth coloration defines a spade suit, and providing a first, second, third, and fourth set of darts, wherein each set of darts is defined by five individual darts, wherein the first set of darts defines the club designation, the second set of darts defines the heart designation, the third set of darts defines the diamond designation, and the fourth set of darts defines the spade designation, and the playing board including an outer circular target array, including spaced adjacent triangular targets of contrasting colors and suit designations, and an inner circular array of triangular target zones defining contrasting colorations and suit designations, and a central bull's-eye target, wherein the outer and inner circular array of triangular targets define fifty-two playing cards of a bridge-type playing deck, and including equally spaced blank triangular target zones, and defining equally spaced "wild" target zones, and providing each player five darts from the first, second, third, and fourth set of darts and directing each player to impact a triangular target zone corresponding to a suit designation of each respective dart, wherein each suit deck designation includes the club, heart, diamond, and spade designation to assemble poker arrays of card designations by impacting a triangular target zone to correspond to the desired poker type array, and randomly providing each player of a plurality of players with said five darts of the sets of darts, and directing each player to direct said five darts at the playing board to obtain a poker hand, and awarding a winning player with a poker hand of greatest value in a hierarchy of poker.

* * * * *